US011211705B2

(12) United States Patent
Kim et al.

(10) Patent No.: US 11,211,705 B2
(45) Date of Patent: Dec. 28, 2021

(54) BEAMFORMING ANTENNA MODULE COMPRISING LENS

(71) Applicant: SAMSUNG ELECTRONICS CO., LTD., Suwon-si (KR)

(72) Inventors: Yoongeon Kim, Suwon-si (KR); Seungtae Ko, Suwon-si (KR); Hyunjin Kim, Suwon-si (KR); Junsig Kum, Suwon-si (KR); Youngju Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/766,054

(22) PCT Filed: Nov. 19, 2018

(86) PCT No.: PCT/KR2018/014203
§ 371 (c)(1),
(2) Date: May 21, 2020

(87) PCT Pub. No.: WO2019/124760
PCT Pub. Date: Jun. 27, 2019

(65) Prior Publication Data

US 2020/0350678 A1 Nov. 5, 2020

(30) Foreign Application Priority Data

Dec. 19, 2017 (KR) ..... 10-2017-0175072

(51) Int. Cl.
*H01Q 19/06* (2006.01)
*H01Q 3/36* (2006.01)
(Continued)

(52) U.S. Cl.
CPC ..... *H01Q 3/36* (2013.01); *H01Q 3/46* (2013.01); *H01Q 15/02* (2013.01); *H01Q 19/06* (2013.01);
(Continued)

(58) Field of Classification Search
CPC ..... H01Q 19/06; H01Q 15/02; H01Q 19/062; H01Q 25/008; H01Q 3/36; H01Q 21/0031;
(Continued)

(56) References Cited

U.S. PATENT DOCUMENTS 10,116,051 B2 * 10/2018 Scarborough ..... H01Q 3/14
10,116,058 B2 * 10/2018 Oh ..... H01Q 15/10
(Continued)

FOREIGN PATENT DOCUMENTS

JP 2010-526318 7/2010
KR 10-2017-0019932 2/2017
(Continued)

OTHER PUBLICATIONS

International Search report for PCT/KR2018/014203, dated Feb. 26, 2019, 4 pages.
(Continued)

*Primary Examiner* — Vibol Tan
(74) *Attorney, Agent, or Firm* — Nixon & Vanderhye, P.C.

(57) ABSTRACT

The present invention relates to a communication technique, which is a convergence of IoT technology and 5G communication system for supporting higher data transmission rate beyond 4G system, and a system for same. The present invention can be applied to smart services (e.g. smart homes, smart buildings, smart cities, smart cars or connected cars, health care, digital education, retail business, security- and safety-related services and the like) on the basis of 5G
(Continued)

communication technology and IoT-related technology. The present invention provides an antenna module comprising: a first antenna array configured to form a beam in a specific direction; a second antenna array spaced a predetermined first distance apart from the first antenna array and configured to form a beam in a specific direction; and a lens spaced a predetermined second distance apart from beam radiation surfaces of the first antenna array and the second antenna array and configured to change phases of the beams radiated from the first antenna array and the second antenna array, wherein the lens is divided into a first region and a second region that have different phase-quantized resolutions.

20 Claims, 15 Drawing Sheets

(51) Int. Cl.
*H01Q 15/02* (2006.01)
*H01Q 21/22* (2006.01)
*H01Q 3/46* (2006.01)
*G16Y 10/75* (2020.01)

(52) U.S. Cl.
CPC ..... *H01Q 19/062* (2013.01); *H01Q 21/22* (2013.01); *G16Y 10/75* (2020.01)

(58) Field of Classification Search
CPC .... H01Q 21/065; H01Q 25/007; H01Q 15/08; H01Q 1/243; H01Q 3/46; H01Q 21/22; H01Q 21/061; H01Q 21/0025; G16Y 10/75
See application file for complete search history.

(56) References Cited

U.S. PATENT DOCUMENTS

| | | | | |
|---|---|---|---|---|
| 10,931,029 | B2 * | 2/2021 | Ko | H01Q 15/04 |
| 10,950,937 | B2 * | 3/2021 | Ko | H01Q 3/32 |
| 2008/0272955 | A1 | 11/2008 | Yonak et al. | |
| 2014/0313090 | A1 | 10/2014 | Oh et al. | |
| 2015/0009080 | A1 | 1/2015 | Oh et al. | |
| 2015/0200452 | A1 | 7/2015 | Oh et al. | |
| 2016/0240923 | A1 * | 8/2016 | Oh | H01Q 19/062 |
| 2017/0062944 | A1 | 3/2017 | Zimmerman et al. | |
| 2017/0201014 | A1 | 7/2017 | Lee et al. | |
| 2017/0271762 | A1 | 9/2017 | Ko et al. | |
| 2020/0021034 | A1 | 1/2020 | Ko et al. | |

FOREIGN PATENT DOCUMENTS

| | | |
|---|---|---|
| KR | 10-2017-0082799 | 7/2017 |
| KR | 10-2017-0108365 | 9/2017 |
| KR | 10-2018-0096287 | 8/2018 |
| KR | 10-2018-0096362 | 8/2018 |

OTHER PUBLICATIONS

Written Opinion of the ISA for PCT/KR2018/014203, dated Feb. 26, 2019, 7 pages.
Yujie Liu et al., "Design of High Efficiency Broadband Fresnel Zone lens antenna at K Band", 2015 IEEE 4th Asia-Pacific Conference on Antennas and Propagation (APCAP), Jun. 30-Jul. 3, 2015, 8 pages.
Extended Search Report dated Nov. 10, 2020 in counterpart European Patent Application No. 18890038.5.

* cited by examiner

BEAMFORMING ANTENNA MODULE COMPRISING LENS

This application is the U.S. national phase of International Application No. PCT/KR2018/014203 filed 19 Nov. 2018, which designated the U.S. and claims priority to KR Patent Application No. 10-2017-0175072 filed 19 Dec. 2017, the entire contents of each of which are hereby incorporated by reference.

TECHNICAL FIELD

The disclosure relates to a beamforming antenna module including a lens to secure high gain and wide coverage in a 5G communication system.

BACKGROUND ART

To meet the demand for wireless data traffic having increased since deployment of 4G communication systems, efforts have been made to develop an improved 5G or pre-5G communication system. Therefore, the 5G or pre-5G communication system is also called a "Beyond 4G Network" or a "Post LTE System". The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), full dimensional MIMO (FD-MIMO), array antenna, an analog beam forming, large scale antenna techniques are discussed in κG communication systems. In addition, in 5G communication systems, development for system network improvement is under way based on advanced small cells, cloud radio access networks (RANs), ultra-dense networks, device-to-device (D2D) communication, wireless backhaul, moving network, cooperative communication, coordinated multi-points (CoMP), reception-end interference cancellation and the like. In the 5G system, hybrid FSK and QAM modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have also been developed.

The Internet, which is a human centered connectivity network where humans generate and consume information, is now evolving to the Internet of things (IoT) where distributed entities, such as things, exchange and process information without human intervention. The Internet of everything (IoE), which is a combination of the IoT technology and the big data processing technology through connection with a cloud server, has emerged. As technology elements, such as "sensing technology", "wired/wireless communication and network infrastructure", "service interface technology", and "security technology" have been demanded for IoT implementation, a sensor network, a machine-to-machine (M2M) communication, machine type communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing information technology (IT) and various industrial applications.

In line with this, various attempts have been made to apply 5G communication systems to IoT networks. For example, technologies such as a sensor network, machine type communication (MTC), and machine-to-machine (M2M) communication may be implemented by beamforming, MIMO, and array antennas. Application of a cloud radio access network (RAN) as the above-described big data processing technology may also be considered an example of convergence of the 5G technology with the IoT technology.

SUMMARY

In the Multi-Input Multi-Output (MIMO) communication environment described above, a plurality of antenna arrays may be included in one antenna and a lens for improving the coverage and gain of electronic waves may be attached to each of the antenna arrays.

The lens is a device that improves the performance of the antenna array by changing the phase of electronic waves radiated from the antenna array, so, generally, the structure of the lens may be determined based on the antenna or the antenna array that is combined with the lens.

The disclosure provides an antenna module including: a first antenna array configured to form a beam in a specific direction; a second antenna array spaced a predetermined first distance apart from the first antenna array and configured to form a beam in a specific direction; and a lens spaced a predetermined second distance apart from beam radiation surfaces of the first antenna array and the second antenna array and configured to change phases of the beams radiated from the first antenna array and the second antenna array, in which the lens is divided into a first region and a second region that have different phase-quantized resolutions.

The first region may be a region to which the beam radiated from the first antenna array and the beam radiated from the second antenna array are transmitted with overlapping, and the second region may be a region to which the beam radiated from the first antenna array or the beam radiated from the second antenna array is transmitted without overlapping a beam radiated from another antenna array.

The phase-quantized resolution of the first region may be 180° and the phase-quantized resolution of the second region may be less than 180°.

The second region may include a third region to which only the beam radiated from the first antenna array is transmitted and a fourth region to which only the beam radiated from the second antenna array is transmitted, and quantized resolutions of the third region and the fourth region may be different from each other.

The lens may be a plane lens in which unit cells having a plurality of shapes are combined, and a phase of a beam that is changed through the lens may be determined based on the shapes of the unit cells.

The first region may be formed by combining a unit cell having a first shape and a unit cell having a second shape.

The number of kinds of unit cell shapes constituting the first region and the second region may be determined based on quantized resolutions of the regions, and the number of kinds of unit cell shapes of the second region may be larger than the number of kinds of unit cells of the first region.

The disclosure provides an antenna module including: a first antenna array configured to form a beam in a specific direction; a second antenna array spaced apart from the first antenna array and configured to form a beam in a specific direction; a first lens disposed in a region to which the beam radiated from the first antenna array and the beam radiated from the second antenna array are transmitted with overlapping, and configured to change phases of the transmitted beams; and a second lens disposed in a region to which the beam radiated from the first antenna array or the beam radiated from the second antenna array is transmitted without overlapping a beam radiated from another antenna array, and configured to change phases of the transmitted beams.

Phase-quantized resolutions of the first lens and the second lens may be different from each other.

The phase-quantized resolution of the first lens may be 180° and the phase-quantized resolution of the second lens may be less than 180°.

The second lens may include: a third lens to which only the beam radiated from the first antenna array is transmitted; and a fourth region to which only the beam radiated from the second antenna array is transmitted, and quantized resolutions of the third lens and the fourth lens may be different from each other.

The first lens and the second lens may be plane lenses in which unit cells having a plurality of shapes are combined, and phases of beam that are changed through the first lens and the second lens may be determined based on the shapes of the unit cells.

The first lens may be formed by combining a unit cell having a first shape and a unit cell having a second shape.

The number of kinds of unit cell shapes constituting the first lens and the second lens may be determined based on quantized resolutions of the lenses, and the number of kinds of unit cell shapes of the second lens may be larger than the number of kinds of unit cells of the first lens.

The disclosure provides a communication device including: a first antenna array configured to form a beam in a specific direction; a second antenna array spaced a predetermined first distance apart from the first antenna array and configured to form a beam in a specific direction; and a lens spaced a predetermined second distance apart from beam radiation surfaces of the first antenna array and the second antenna array and configured to change phases of the beams radiated from the first antenna array and the second antenna array, in which the lens is divided into a first region and a second region that have different phase-quantized resolutions.

According to the disclosure, since it is possible to dispose a lens for each antenna array even if a plurality of antenna arrays are disposed in one antenna module, it is possible to improve the gain values of the antenna arrays.

Further, according to the disclosure, it is possible to prevent beam distortion of an antenna module that may occur when a plurality of antenna arrays is disposed close to each other.

DETAILED DESCRIPTION

Figure 1:
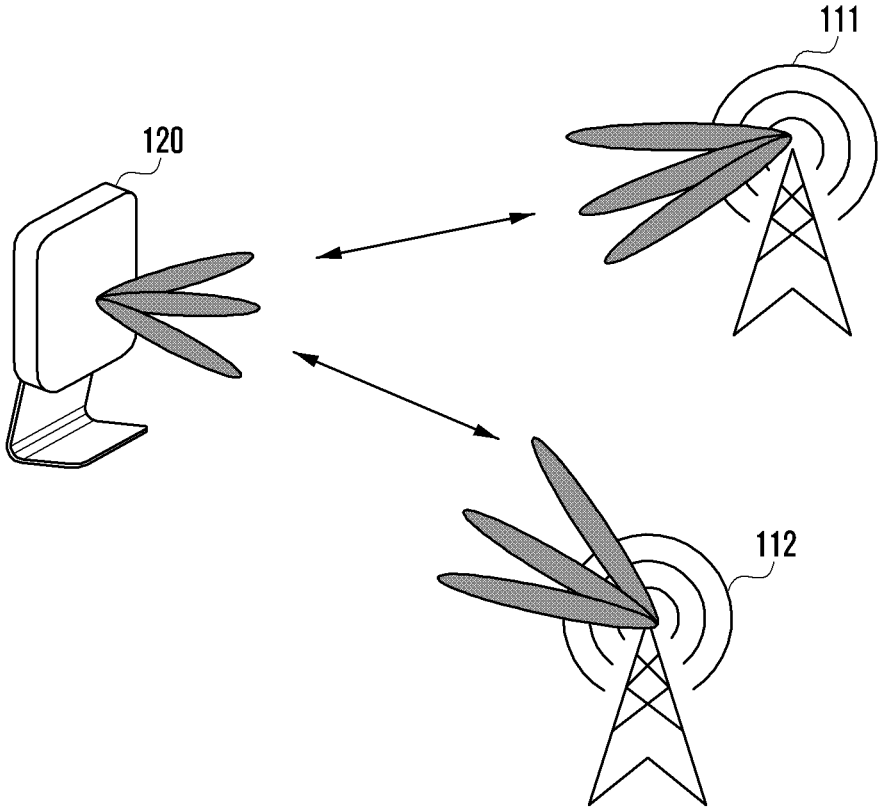
FIG. 1 is a view showing a mobile communication system that supports beam forming.

In describing embodiments of the disclosure, descriptions related to technical contents well-known in the art and not associated directly with the disclosure will be omitted. Such an omission of unnecessary descriptions is intended to prevent obscuring of the main idea of the disclosure and more clearly transfer the main idea.

For the same reason, in the accompanying drawings, some elements may be exaggerated, omitted, or schematically illustrated. Further, the size of each element does not completely reflect the actual size. In the drawings, identical or corresponding elements are provided with identical reference numerals.

The advantages and features of the disclosure and ways to achieve them will be apparent by making reference to embodiments as described below in detail in conjunction with the accompanying drawings. However, the disclosure is not limited to the embodiments set forth below, but may be implemented in various different forms. The following embodiments are provided only to completely disclose the disclosure and inform those skilled in the art of the scope of the disclosure, and the disclosure is defined only by the scope of the appended claims. Throughout the specification, the same or like reference numerals designate the same or like elements.

Here, it will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks. These computer program instructions may also be stored in a computer usable or computer-readable memory that can direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Further, each block of the flowchart illustrations may represent a module, segment, or portion of code, which includes one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

As used herein, the "unit" refers to a software element or a hardware element, such as a Field Programmable Gate Array (FPGA) or an Application Specific Integrated Circuit (ASIC), which performs a predetermined function. However, the "unit" does not always have a meaning limited to software or hardware. The "unit" may be constructed either to be stored in an addressable storage medium or to execute one or more processors. Therefore, the "unit" includes, for example, software elements, object-oriented software elements, class elements or task elements, processes, functions, properties, procedures, sub-routines, segments of a program code, drivers, firmware, micro-codes, circuits, data, database, data structures, tables, arrays, and parameters. The elements and functions provided by the "unit" may be either combined into a smaller number of elements, or a "unit", or divided into a larger number of elements, or a "unit". Moreover, the elements and "units" or may be implemented to reproduce one or more CPUs within a device or a security multimedia card. Further, the "unit" in the embodiments may include one or more processors.

FIG. 1 is a view showing a mobile communication system that supports beam forming;

FIG. 1 is a view showing communication between a communication device 120 including an antenna module according to the disclosure and a plurality of base stations 111 and 112. As described above, 5G mobile communication may have a wide frequency bandwidth.

However, the coverage and gain value of electronic waves that are transmitted from the base stations 111 and 112 or the communication device 120 may correspondingly decrease. Accordingly, a beam forming technique is fundamentally used in a 5G mobile communication system to solve this problem.

That is, the base stations 111 and 112 or the communication device 120 that includes an antenna module supporting a 5G mobile communication system may generate beams at various angles and may perform communication using a beam with the best communication environment of the generated beams.

Referring to FIG. 1, for example, the communication device 120 may generate three kinds of beams that are radiated at different angles, and accordingly, a base station may also generate three kinds of beams that are radiated at different angles. For example, the communication device 120 may radiate three kinds of beams with beam indexes 1, 2, and 3, the first base station 111 may radiate three kinds of beams with indexes 4, 5, and 6, and the second base station 112 may radiate three kinds of beams with beam indexes 7, 8, and 9.

In this case, in communication between the communication device 120 and the first and second base stations 111 and 112, the communication device and the first base station may perform communication using the beam with the beam index 2 of the communication device 120 and the beam with the beam index 5 of the first base station 111, in which the beams have the best communication environment. The communication device 120 and the second base station 112 may also perform communication in the same way.

Only an embodiment to which a 5G communication system may be applied is in FIG. 1. That is, the number of beams that the communication device or the base stations may radiate may increase or decrease, so the range of the disclosure should not be limited to the number of beams shown in FIG. 1.

The communication device 120 shown in FIG. 1 includes various devices that may perform communication with base stations. For example, a Customer Premises Equipment (CPE) or a radio repeater may be included therein.

Figure 2:
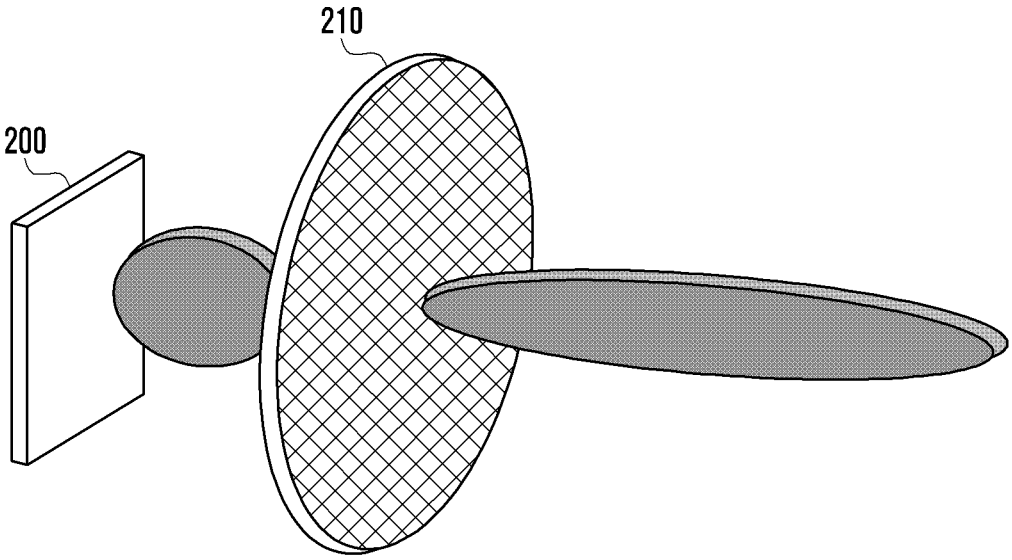
FIG. 2 is a view showing the structure of an antenna module including a lens.

FIG. 2 is a view showing the structure of an antenna module including a lens.

An antenna module according to the disclosure may include an antenna 200 including at least one antenna array and a lens 210. That is, the antenna 200 according to the disclosure may include a plurality of antenna arrays. For example, four antenna arrays may be included in one antenna 200 and it is possible to determine the angles of beams finally radiated from the antenna 200 by adjusting each of the angles of beams radiated from the antenna arrays.

The beams radiated from the antenna 200 may pass through a lens 210 spaced a predetermined distance apart from the antenna 200. The lens 210 may change the phases of beams (or electronic waves) incident on the lens.

In detail, the lens 210 may change the phase values of all beams incident on the lens 210 to the same phase value, using a pattern formed in the lens, and then may send the beams out of the lens 210.

Accordingly, the beams radiated out through the lens 210 have shaper shapes than the beams radiated from the antenna 200. That is, it is possible to improve the gain values of the beams radiated from the antenna 200 using the lens 210. Improving the gain values of beams and changing the phases of beams using the lens 210 are described hereafter in more detail with reference to FIGS. 3A to 3C.

Figure 3A:
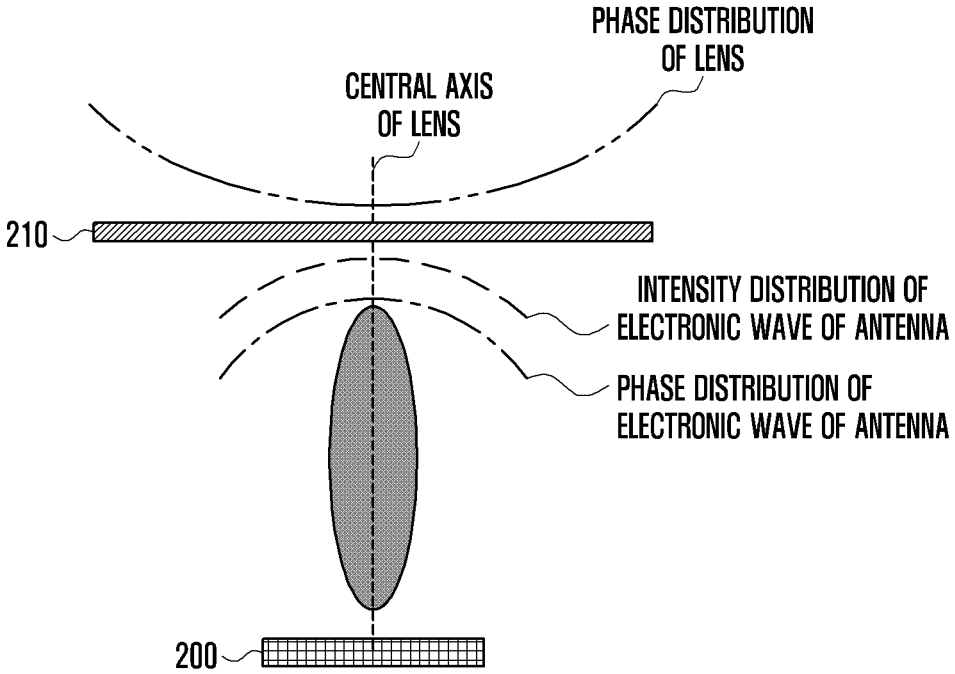
FIG. 3A is a view showing the structure of an antenna module when one antenna array is disposed in an antenna.

FIG. 3A is a view showing the structure of an antenna module when one antenna array is disposed in an antenna.

When only one antenna array 200 is disposed in an antenna, electronic waves (or beams) radiated from the antenna array 200 may have the shape shown in FIG. 3A, and intensity distribution and phase distribution of the radiated electronic waves may have a parabolic shape around a central axis of the electronic waves, as shown in FIG. 3A.

The lens 210 spaced a predetermined distance apart from the antenna array 200 may be disposed such that the central axis of the lens coincides with the central axis of the electronic waves. In this case, the phase distribution of the lens 210 may be a parabola having a shape opposite to the shape of the phase distribution of the electronic wave. (The phase distribution of the lens may be determined by the pattern formed in the lens, as described above. A method of forming the pattern of the lens for determining the phase distribution is out of the range of the disclosure, so it is not described in detail.)

That is, according to the structure of the antenna module shown in FIG. 3A, the central axis of the lens and the central axis of the electronic waves coincide with each other, and all of the lens phase distribution center, the electronic wave phase distribution center of the antenna, and the electronic wave intensity distribution center of the antenna coincide with one another.

Figure 3B:
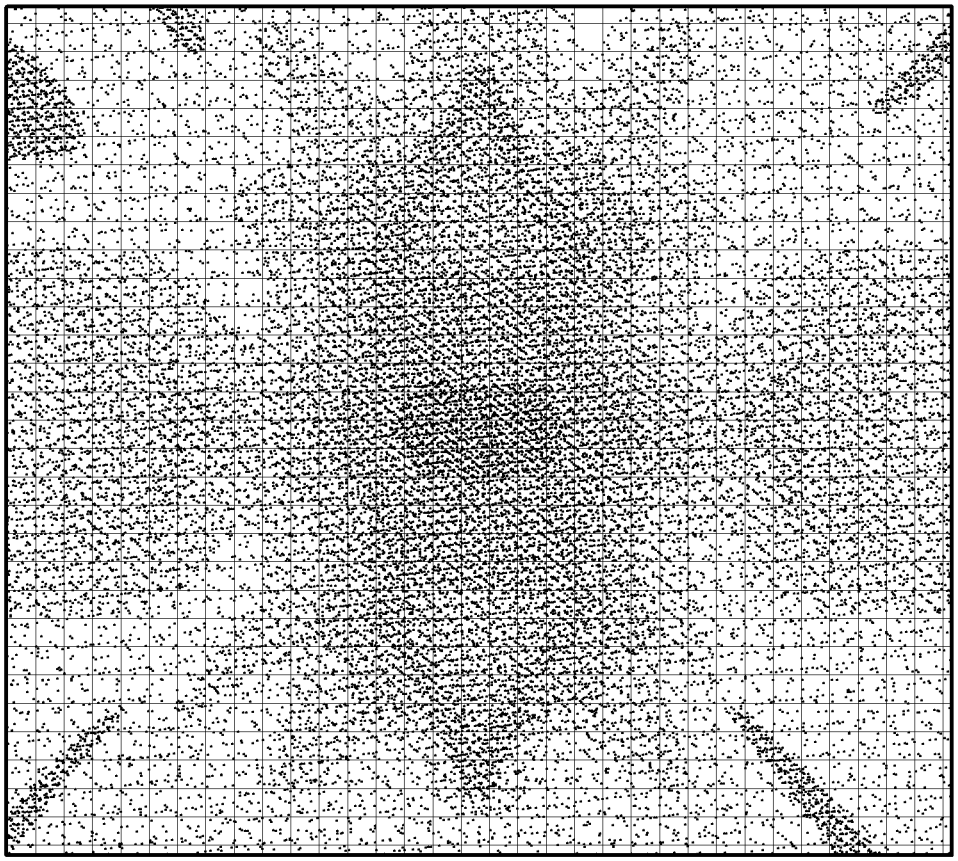
FIG. 3B is a view showing intensity distribution of a beam radiated through a lens when one antenna array is disposed in an antenna.
Figure 3C:
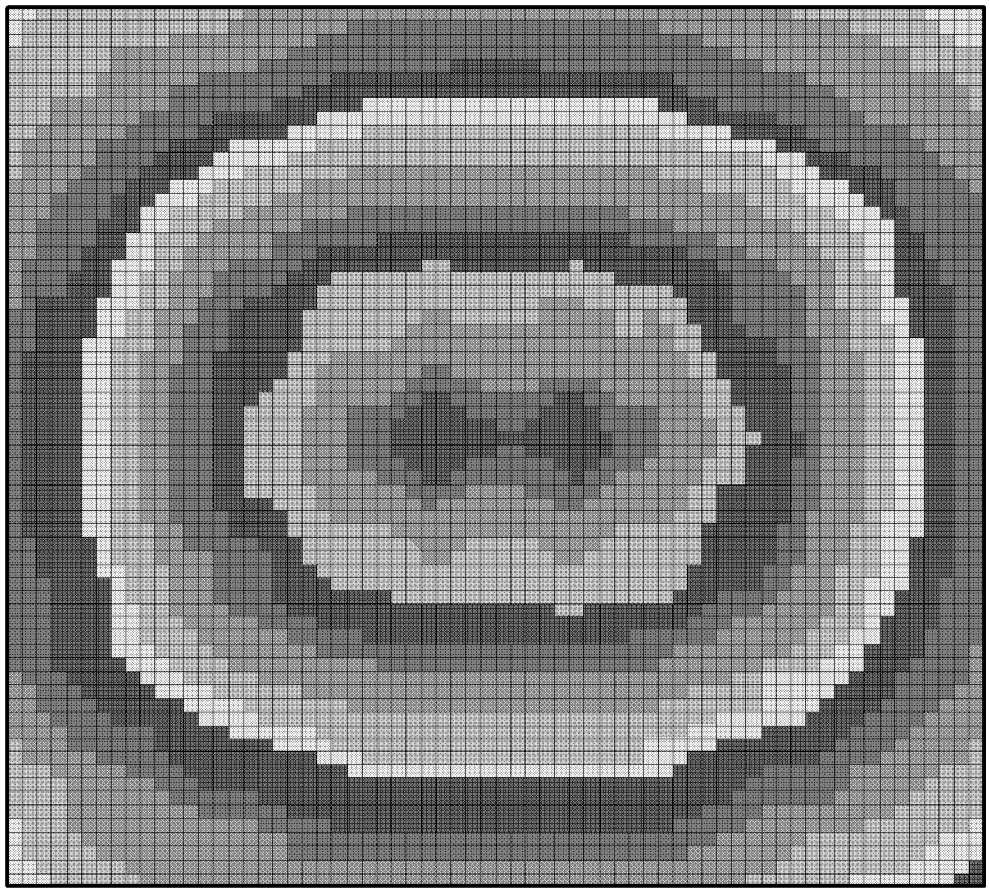
FIG. 3C is a view showing phase distribution of a beam radiated through a lens when one antenna array is disposed in an antenna.

According to the structure of the antenna module shown in FIG. 3A, a view showing the intensity distribution of beams radiated through the lens is FIG. 3B and a view showing the phase distribution of the beams is FIG. 3C.

It can be seen from FIGS. 3B and 3C that the closer to the central axis of the lens, larger the gain value of the electronic waves radiated through the lens, and the phase value of the electronic waves are also formed such that the central axis of the lens and the central axis of the electronic waves coincide with each other.

Meanwhile, a plurality of antenna arrays may be included in one antenna. In particular, in a Multi-Input Multi-Output (MIMO) communication environment, the necessity of an antenna including a plurality of antenna arrays increases.

Figure 4:
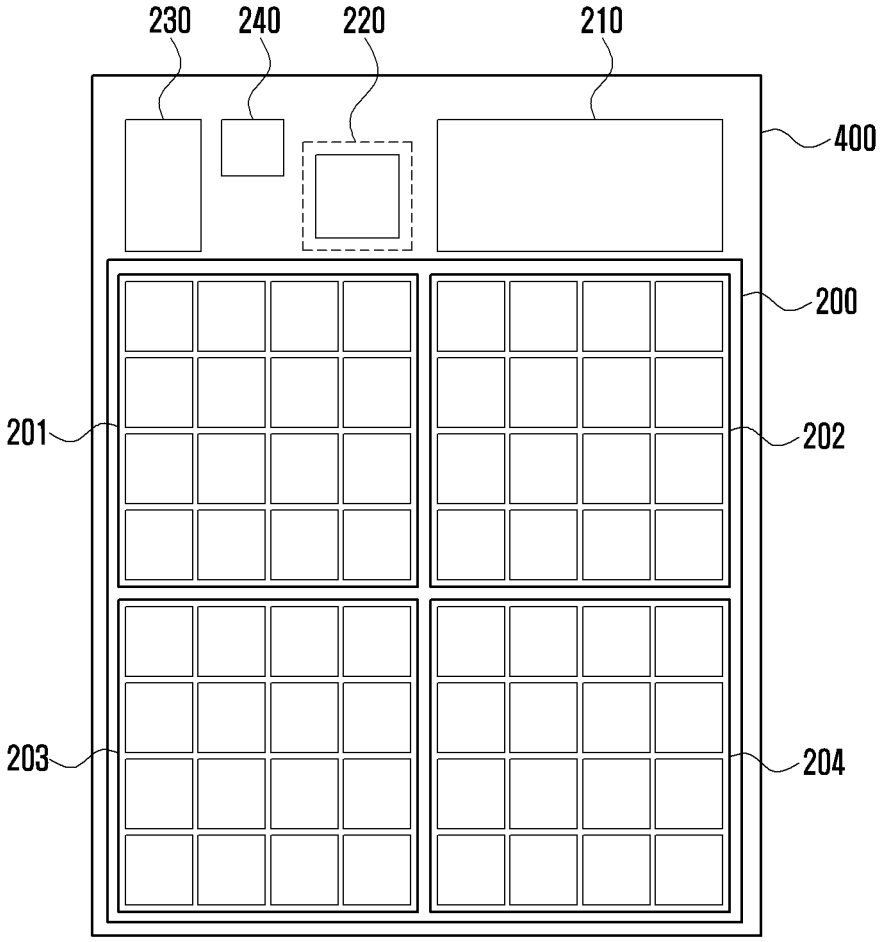
FIG. 4 is a view showing the configuration of an antenna module when a plurality of antenna arrays is disposed in an antenna in accordance with an embodiment of the disclosure.

FIG. 4 is a view showing the configuration of an antenna module when a plurality of antenna arrays is disposed in an antenna in accordance with an embodiment of the disclosure.

An antenna module 400 according to the disclosure may include an antenna 200 including one or more antenna arrays 201, 202, 203, and 204. The antenna arrays 201, 202, 203, and 204 each may include a plurality of antenna elements. For example, one antenna array, as shown in FIG. 4, may be composed of 16 antenna elements and may generate beams at various angles by controlling the antenna elements.

The antenna module 400 may further include various components, if necessary. For example, the antenna module 400 may further include a connector 230 for providing power to the antenna module 400 and a DC/DC converter that converts voltage provided through the connector 230.

The antenna module 400 may further include a Field Programmable Gate Array (FPGA) 220. The FPGA 220 is a semiconductor device including a designable logic device and a programmable internal wire. The designable logic device may perform programming by duplicating logic gates such as AND, OR, XOR, and NOT and a more complicated decoder function. The FPGA may further include a flip-flop or a memory.

The antenna module 400 may further include a Low-DropOut (LDO) regulator 240. The LDO regulator 240 is a regulator that has high efficiency when an output voltage lower than an input voltage and the voltage difference between the input voltage and the output voltage is small, and may remove noise of input power. The LDO regulator 240 may also perform a function that stabilizes a circuit by positioning a dominant pole in a circuit because the output impedance is low.

Meanwhile, since the structure of an antenna module according to an embodiment of the disclosure is shown in FIG. 4, the scope of the disclosure should not be limited to the structure of the antenna module shown in FIG. 4.

That is, FIG. 4 shows the case in which one antenna is composed of four antenna arrays, but it is possible to increase or decrease the number of antenna arrays included in one antenna, if necessary. Further, the connector 230, DC/DC converter 210, FPGA 220, or LDO regulator 240 that is described above may be added or removed, if necessary.

A lens may be added to the antenna module 400 for improving the coverage or gain value of beams that are radiated from the antenna 200. The lens may be formed of a plane lens and may be configured by combining unit cells having a plurality of shapes.

In more detail, the lens may have phase distribution by itself by combining unit cells and the phase distribution of electronic waves incident from the antenna 200 may be combined with the phase distribution of the lens. Accordingly, the phase distribution of electronic waves radiated outside through the lens may be different from the phase distribution of the electronic waves incident the antenna 200, and it is possible to improve the gain value of the electronic waves radiated out of the lens by changing the phase distribution of the electronic waves.

However, unlike the structure shown in FIG. 2 in which only one antenna array is disposed in an antenna, when a plurality of antenna arrays is disposed, lenses may be disposed with different characteristics for each of the antenna arrays. This is because the phase distributions of electronic waves radiated from the antenna arrays may be different from each other.

For example, as shown in FIG. 4, when four antenna arrays 201, 202, 203, and 204 are included in one antenna 200, lenses with different characteristics may be disposed for the antenna arrays, respectively. (The phase distribution of a lens may be included in the characteristics, as described above.) As another embodiment, independent lenses with different characteristics may be disposed for the antenna arrays 201, 202, 203, and 204, respectively. (Obviously, lenses with the same characteristics may be disposed if the phase distributions of electronic waves radiated from the antenna arrays are the same.)

Accordingly, problems when lenses having the same phase distributions (or different phase distributions) are disposed respectively for antenna arrays are described hereafter.

Figure 5A:
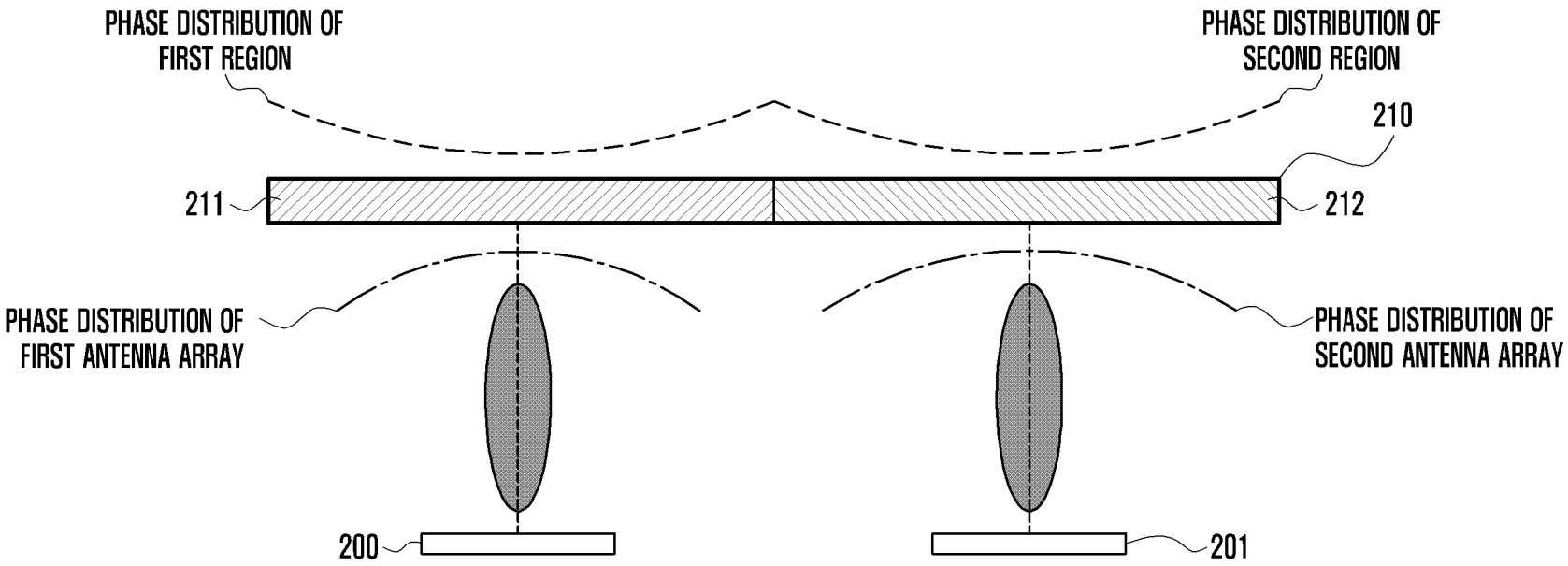
FIG. 5A is a view showing the structure of an antenna module when phase distribution curves of antenna arrays of an antenna module do not overlap each other.

FIG. 5A is a view showing the structure of an antenna module when phase distribution curves of antenna arrays of an antenna module do not overlap each other.

Referring to FIG. 5A, a first antenna array 200 and a second antenna array 201 of an antenna module are spaced apart from each other with a sufficient gap therebetween. The sufficient gap means a gap that is such that the phase distribution of electronic waves radiated from the first antenna array 200 and the phase distribution of electronic waves radiated from the second antenna array 201 do not overlap each other.

In this case, in correspondence to the phase distribution of the first antenna array 200 and the phase distribution of the second antenna array 201, the phase distribution of a first region 211 of the lens 210 and the phase distribution of a second region 212 of the lens 210 do not overlap each other.

That is, the first region 211 of the lens 210 may change only the phase of the first antenna array 200 without interference with the second antenna array 201 and the second region 212 of the lens 210 may change only the phase of the second antenna array 201 without interference with the first antenna array 200.

Accordingly, when a sufficient gap is secured between the antenna arrays, as shown in FIG. 5A, it is possible to dispose lenses to respectively correspond to antenna arrays in an antenna module.

Figure 5B:
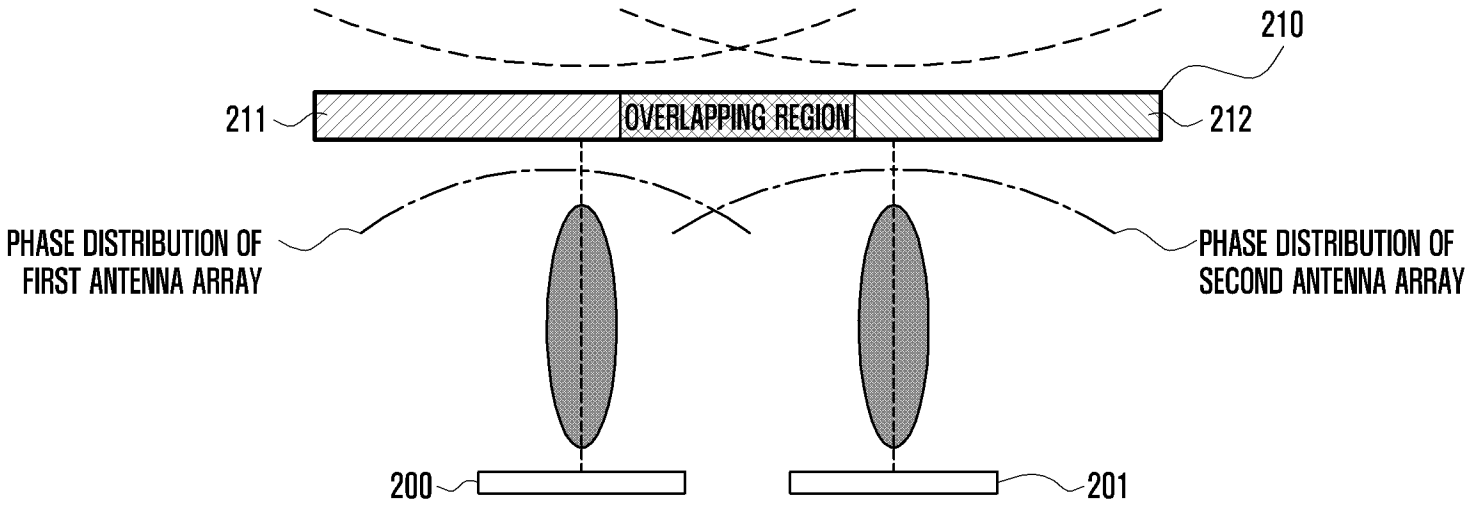
FIG. 5B is a view showing the structure of an antenna module when phase distribution curves of antenna arrays of an antenna module overlap each other.

FIG. 5B is a view showing the structure of an antenna module when phase distribution curves of antenna arrays of an antenna module overlap each other.

A sufficient distance is not secured between antenna arrays in the antenna module shown in FIG. 5B. That is, FIG. 5B shows the configuration of an antenna module in case that the phase distribution of electronic waves radiated from the first antenna array 200 and the phase distribution of electronic waves radiated from the second antenna array 201 overlap each other.

In general, as the electronic devices including antenna modules are decreased in size, it becomes difficult to secure a sufficient gap between antenna arrays with the technological tendency. That is, the structure of an antenna module shown in FIG. 5A is the most ideal, but if necessary, it may be unavoidable to use the structure of an antenna module shown in FIG. 5B in some cases.

However, it is difficult to use the structure of an antenna module shown in FIG. 5A even in the situation shown in FIG. 5B. First, there is a region in which the phase distributions of the first region 211 of the lens 210 and the second region 212 of the lens 210 overlap each other. Accordingly, it may be a problem to fit the characteristic of the overlapping lens portion to which one of the lens characteristic of the first region 211 and the lens characteristic of the second region 212.

Further, second, since the electronic waves radiated from the first antenna array 200 and the electronic waves radiated from the second antenna array 201 are both transmitted to the overlapping region, how to change the phases of the electronic waves radiated from the first antenna array 200 and the second antenna array 201 in the overlapping region may be a problem.

Accordingly, the disclosure proposes a structure of an antenna module for solving the two problems. However, first of all, the detailed structure of an antenna module and corresponding effects in case that a structure of an antenna module in which the characteristic of an overlapping region is fit to the characteristic of the second region 212 is selected to intuitionally solve the two problems are described with reference to FIGS. 5C and 5D.

Figure 5C:
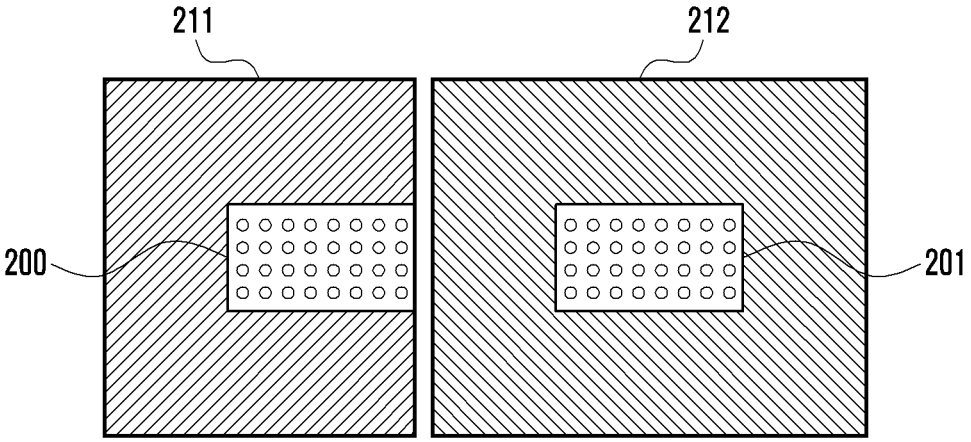
FIG. 5C is a view showing the structure of an antenna module in case that phase distribution curves of antenna arrays of an antenna module overlap each other and a lens is rearranged.

FIG. 5C is a view showing the structure of an antenna module in case that phase distribution curves of antenna arrays of an antenna module overlap each other and a lens is rearranged.

In more detail, as described above, since the characteristic of the lens in the overlapping region should be the same as the characteristic of the lens in the second region, the second region 212 may be defined up to the overlapping region. That is, the lens to which the electronic waves radiated only through the first antenna array 200 are transmitted may be the first region 211 and the lens to which the electronic waves radiated only through the second antenna array 201 and the electronic waves radiated from the first antenna array 200 and the second antenna array 201 are both transmitted may be the second region 212.

Meanwhile, although one lens may have the first region 211 and the second region 212 that have different characteristics in FIG. 5C, a first lens may be disposed in the portion to which the electronic waves radiated only through the first antenna array 200 and a second lens may be disposed in the portion to which the electronic waves radiated only through the second antenna array 201 and the electronic waves radiated from the first antenna array 200 and the second antenna array 201 are both transmitted. That is, the first region 211 and the second region 212 may be a single lens of which only the characteristics are different or may be separate lenses with different characteristics.

Figure 5D:
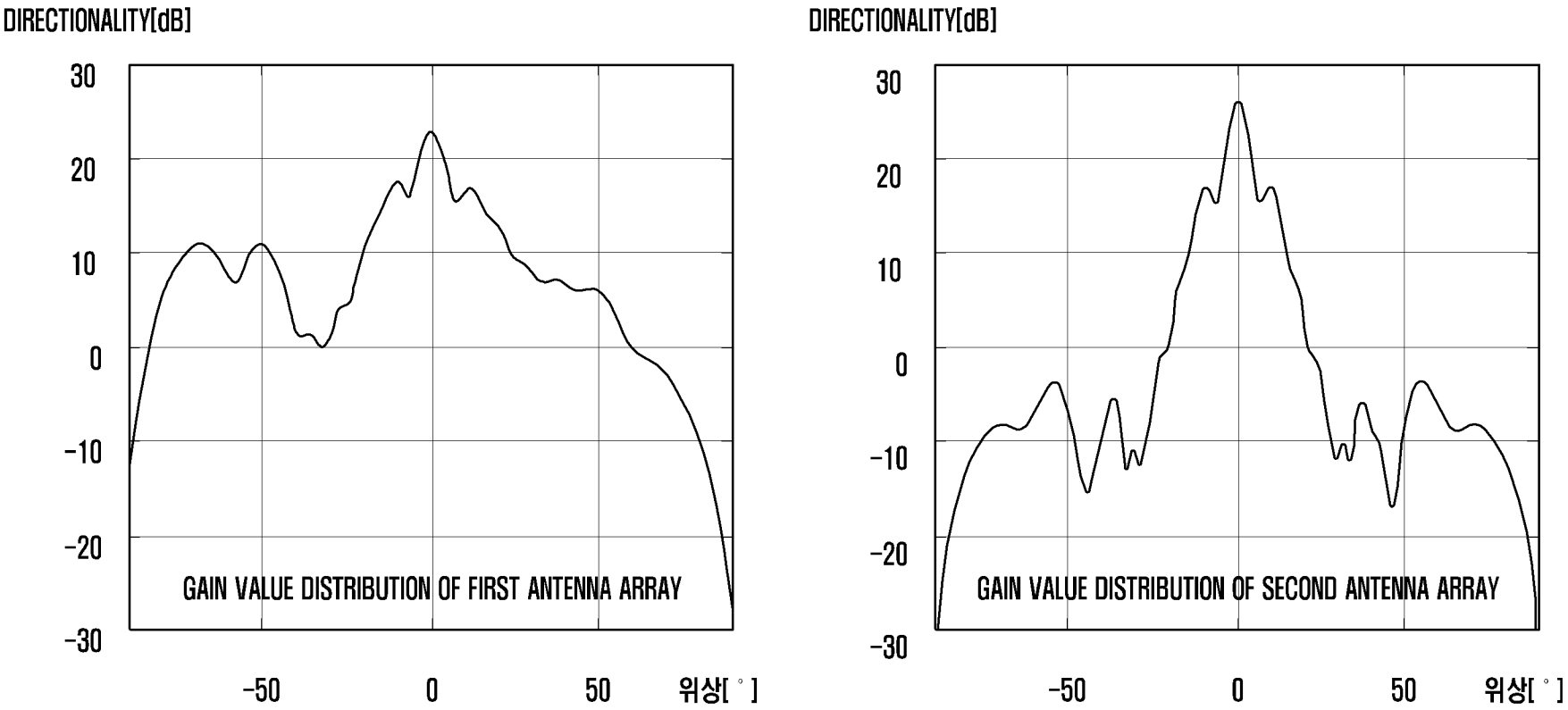
FIG. 5D is a graph showing a beam gain values of antenna arrays that have passed through a lens the lens is rearranged, as shown in FIG. 5C.

FIG. 5D is a graph showing a beam gain value of each antenna array that has passed through a lens the lens is rearranged, as shown in FIG. 5C.

As can be seen from FIG. 5D, the beam gain value distribution of the first antenna array and the beam gain value distribution of the second antenna array are different in the structure of an antenna module shown in FIG. 5C. That is, performance imbalance may be generated between the antenna arrays.

Further, the second region 212 is defined up to an overlapping region and the beam gain value distribution of the second antenna array has symmetric distribution about the central axis, but the beam gain value distribution of the first antenna array does not have symmetric distribution about the central axis. That is, beam distortion may be generated in the first antenna array.

Accordingly, it is intuitionally not preferable to apply the configuration of the antenna module shown in FIG. 5C in order to solve the problems in FIG. 5B. (Although the overlapping region is positioned only in the second region in FIGS. 5C and 5D, it will be the same when the overlapping region is positioned only in the first region.) As a result, a new structure of an antenna module is required to solve the problems and a new structure of an antenna module that can solve all the problems is proposed hereafter.

Figure 6A:
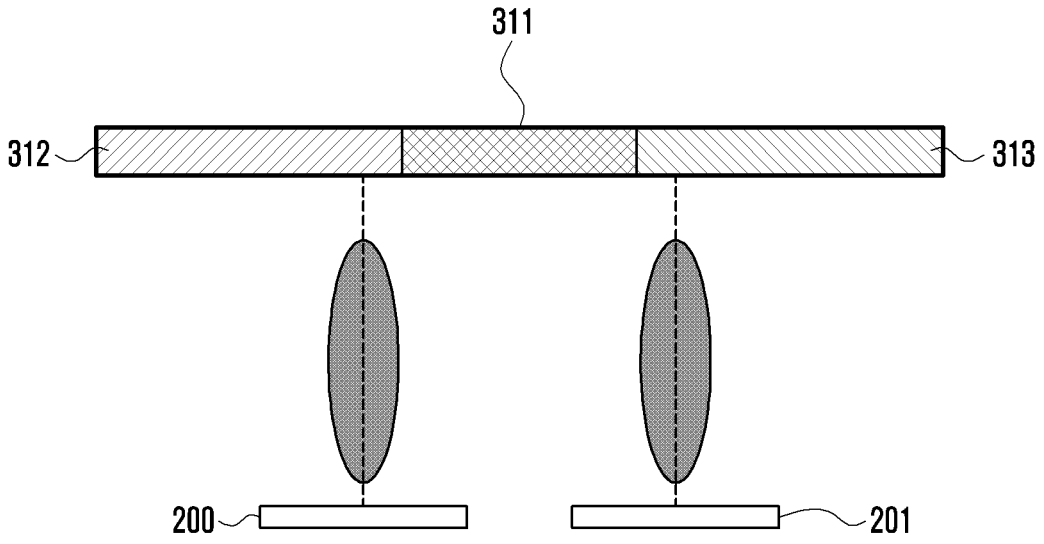
FIGS. 6A and 6B are views showing the configuration of an antenna module according to an embodiment of the disclosure.
Figure 6B:
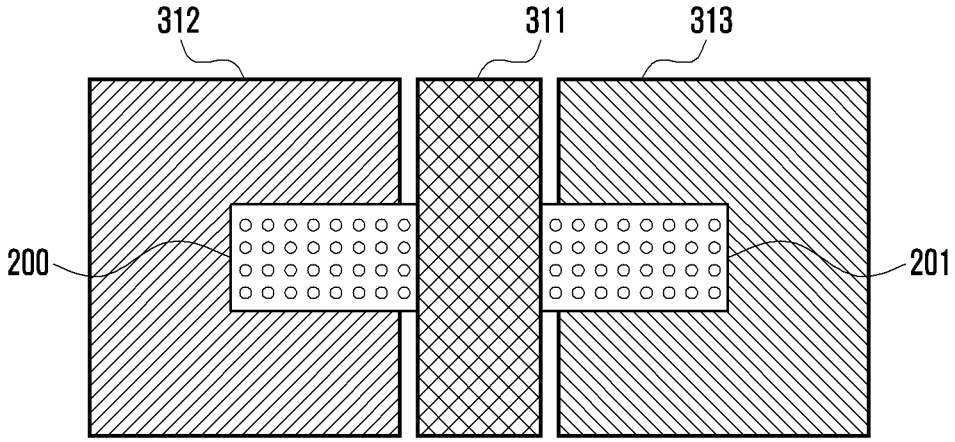

FIGS. 6A and 6B are views showing the configuration of an antenna module according to an embodiment of the disclosure.

As shown in FIG. 6A, an antenna module according to the disclosure includes a first antenna array 200 that forms a beam in a specific direction, a second antenna array 201 that is spaced a predetermined first distance apart from the first antenna array 200 and forms a beam in a specific direction, and a lens 310 that is spaced a predetermined second distance apart from beam radiation surfaces of the first antenna array 200 and the second antenna array 201 and changes the phases of the beams radiated from the first antenna array 200 and the second antenna array 201, in which the lens 310 may be divided into a first region 311 and a second region 312, 313 that have different phase-quantized resolutions.

The first distance, as described above with reference to FIG. 5B, means the gap between the first antenna array 200 and the second antenna array 210 when the beams radiated from the first antenna array 200 and the second antenna array 201 overlap each other.

For example, in case that the gap between the first antenna array 200 and the second antenna array 210 is 30 mm, the first distance may have a value less than 30 mm unless the electronic waves radiated from the first antenna array 200 and the electronic waves radiated from the second antenna array 210 overlap each other.

The first region 311 that is a portion of the lens 310 is a region to which the beam radiated from the first antenna array 200 and the beam radiated from the second antenna array 201 are transmitted with overlapping.

On the other hand, the second region 312, 313 that is a portion of the lens 310 is a region to which the beam radiated from the first antenna array 200 or the beam radiated from the second antenna array 201 is transmitted without overlapping a beam radiated from another antenna array. That is, the second region may be divided into a region 312 to which only the beam radiated from the first antenna array 200 is transmitted and a region 313 to which only the beam radiated from the second antenna array 201 is transmitted.

The characteristics of the beams radiated from the first antenna array 200 and the second antenna array 201 may be different, and accordingly, it may be required to divide the second region of the lens more precisely.

Accordingly, in this case, in the second region of the lens 310, the region to which only the beam radiated from the first antenna array 200 may be defined as a third region 312 and the region to which only the beam radiated from the second antenna array 201 may be defined as a fourth region 313. The characteristics of lens of the third region 312 and the fourth region 313 may be different from each other.

According to an embodiment of the disclosure, regardless of how the second region is divided, a lens having a characteristic different from the second region is disposed in the first region 311 to which the beams radiated from the first antenna array 200 and the second antenna array 201 are transmitted with overlapping.

FIG. 6B shows in more detail a case in which lenses with different characteristics are disposed in the first antenna array 200 and the second antenna array 201, so the structure of an antenna module according to the disclosure is described hereafter based on FIG. 6B.

In detail, the first region 311 and the second region 312, 313 may be different in phase-quantized resolution. The quantized resolution may be a reference that can determine the phase distribution of a lens.

In more detail, the quantized resolution is to classify signals having an analog form, that is, signals having a continuous variation without disconnection into finite levels that discontinuously change with a predetermined width, and to give specific values to the levels. That is, all analog signal values within the range of the width pertaining to a specific level may be replaced with a specific value given to the level. For example, all analog values within the range of 1.5-2.5 may be replaced with a value 2.

That is, the phase distribution of a lens may not be an analog distribution, but a discrete distribution by the quantized resolution of the lens. Accordingly, the phase distribution of a lens may be determined based on the phase-quantized resolution of the lens, so the performance of the lens may be correspondingly determined.

As described above, the phase-quantized resolution of the first region 311 may be different from the phase-quantized resolution of the second region 312, 313. In more detail, the phase-quantized resolution of the first region 311 may be 180° and the phase-quantized resolution of the second region 312, 313 may be less than 180°.

Figure 7:
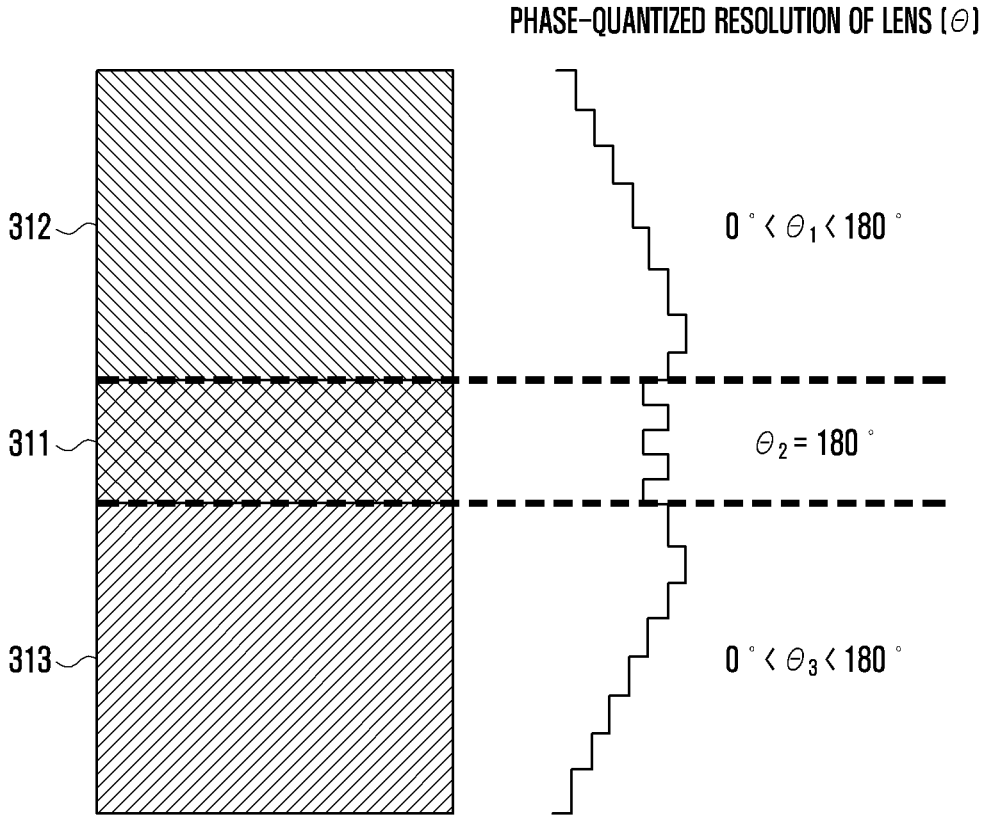
FIG. 7 is a view showing regions of a lens and a phase-quantized resolution of the regions according to an embodiment of the disclosure.

The phase-quantized resolution difference between the first region 311 and the second region 312, 313 is shown in more detail in FIG. 7, so it is described in detail hereafter with reference to FIG. 7.

FIG. 7 is a view showing regions of a lens and a phase-quantized resolution of the regions according to an embodiment of the disclosure.

In FIG. 7, the region indicated by reference numeral 311 is an overlapping region in which beams radiated from a first antenna region and a second antenna region are transmitted with overlapping, and the region indicated by reference numerals 312 and 313 is a non-overlapping region to which only the beam radiated from the first antenna array or the second antenna array is transmitted.

That is, the region indicated by reference numeral 311 is the first region described above and the region indicated by reference numerals 312 and 313 is the second region. (Alternatively, according to the embodiment described above, the region indicated by reference numeral 312 may be the third region and the region indicated by reference numeral 313 may be the fourth region.)

On the other hand, the lens quantized resolution of regions of a lens may be expressed in θ. For example, if the quantized resolution of a lens is 30°, in the phase distribution of the lens, the section 0°~29° may be replaced with 0°, the section 30°~59° may be replaced with 30°, and the latter sections may be replaced this way.

However, when the quantized resolution is 180°, a more specific situation occurs. When the quantized resolution of a lens is 180°, there is only the case that the phase distribution of the lens is 0° and 180°. That is, as shown in FIG. 7, the lens phase distribution of the overlapping region 311 may have a square waveform.

Accordingly, the beam radiated from a first antenna array or the second antenna array and transmitted to the overlapping region 311 may be replaced with a beam with a phase of 0° or 180° by a lens with a phase-quantized resolution of 180°, and by this replacement, the beam radiated from the first antenna array and the beam radiated from the second antenna array may be combined in the overlapping region and radiated to the outside.

The phase-quantized resolution of the lens for the non-overlapping region 312, 313 to which only the beam radiated from the first antenna array or the second antenna array does not need to be 180°. Accordingly, the non-overlapping region 312, 313 may have various phase-quantized resolution values in a range less than 180°, if necessary. (In general, a lower phase-quantized resolution value may be preferable in terms of improvement of the gain value of a lens. However, the smaller the quantized resolution value, the more difficult the manufacturing of a lens and the more cost and time may be consumed to manufacture a lens.)

Figure 8:
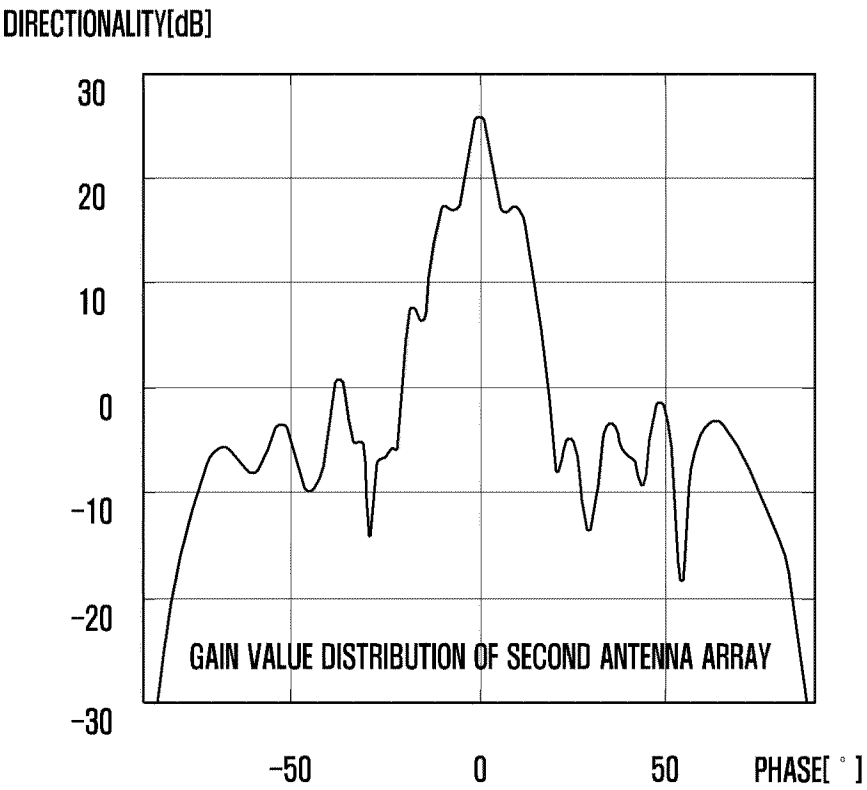
FIG. 8 is a graph showing beam gain values of antenna arrays that have passed through a lens in case that an antenna module according to an embodiment of the disclosure is used.
Figure 8:
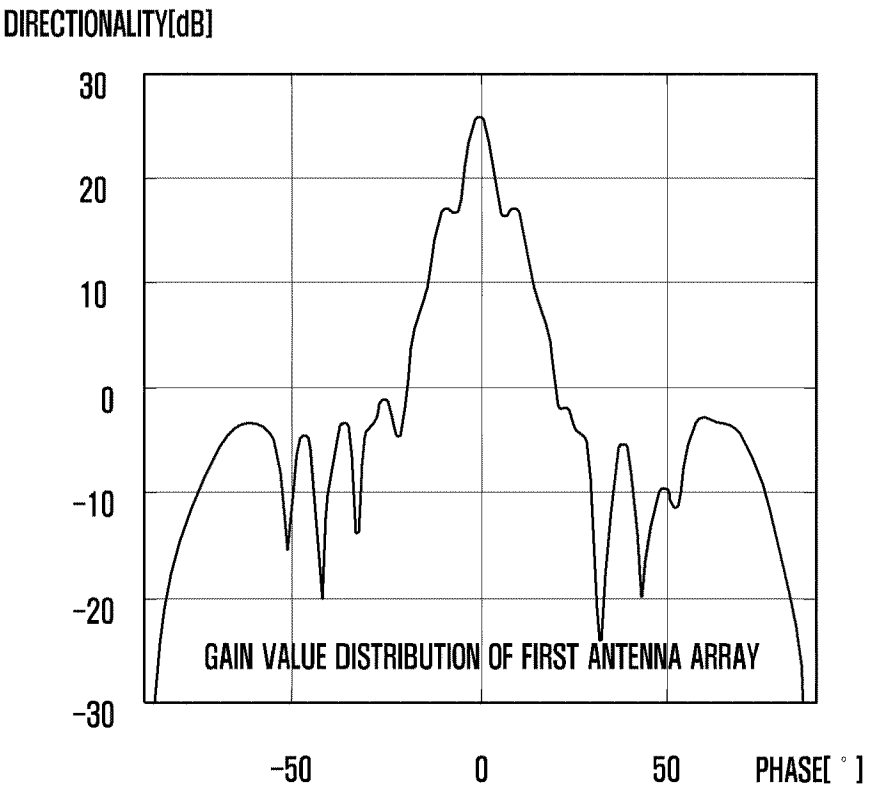

FIG. 8 is a graph showing beam gain values of antenna arrays that have passed through a lens in case that an antenna module according to an embodiment of the disclosure is used.

Unlike the graph shown in FIG. 5D, it can be seen that the gain value distributions of the first antenna array and the second antenna array are similar to each other. Further, it can be seen that the first antenna array and the second antenna array both have similar maximum gain values of the beams radiated through the lens (the maximum beam gain value of the second antenna array is larger than that of the first antenna array in FIG. 5D.). That is, according to the structure of an antenna module disclosed herein, it can be seen that the performance imbalance between the first antenna array and the second antenna array decreases in comparison to the related art.

Further, unlike the graph shown in FIG. 5D, since the beam gain value distributions of the first antenna array and the second antenna array are symmetric with the central axis therebetween, it can be seen that beam distortion does not occur in neither the first antenna array nor the second antenna array.

Figure 9:
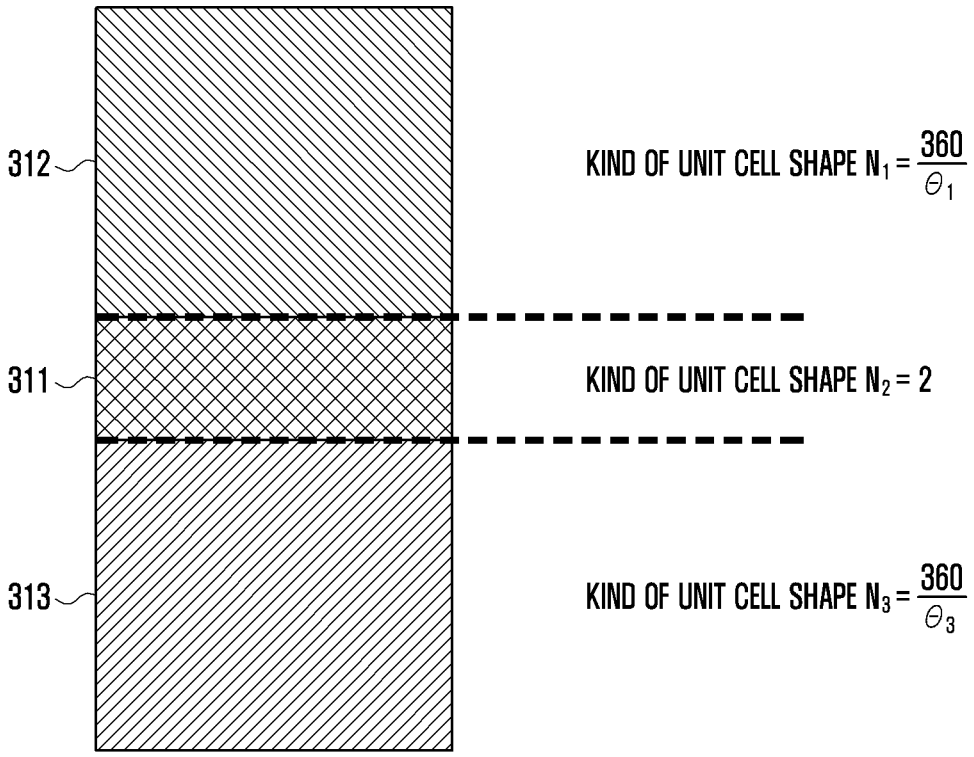
FIG. 9 is a view showing the number of the kinds of unit cell shapes of a lens in an antenna module structure according to the disclosure.

FIG. 9 is a view showing the number of the kinds of unit cell shapes of a lens in an antenna module structure according to the disclosure.

A lens according to the disclosure may be a plane lens in which unit cells having a plurality of shapes are combined and the phase of a beam that is changed through the lens may be determined based on the shapes of the unit cells.

In more detail, the number of phase-quantized resolution of a lens that can be added by one unit cell shape may be one. For helping understanding, for example, as described above, the phase-quantized resolution of the overlapping region 311 may be 180°. In this case, the phase distribution of a beam incident through the lens may be 0° or 180° by the phase-quantized resolution.

That is, the number of phase-quantized resolution in the overlapping region 311 of the lens is two of 0° and 180°. Accordingly, in this case, as shown in FIG. 9, two kinds of unit cells are required.

On the other hand, the phase-quantized resolution of the non-overlapping region 312, 313 of the lens is not 180°. Referring to the previous example, the phase-quantized resolution of the non-overlapping region 312, 313 of the lens may be 30°. That is, in this case, the number of phase-quantized resolutions may be 12 (0°, 30°, 60°, 90°, 120°, 150°, 180°, 210°, 240°, 270°, 300°, and 330°), so twelve kinds of unit cell shapes are required in this case.

The following equation may be determined based on the above description to determine the number of the kinds of unit cell shapes of a lens.

$$N=360°/(\theta)$$

N: number of kinds of unit cell shapes, θ: phase-quantized resolution of lens

The embodiments of the disclosure described and shown in the specification and the drawings have been presented to easily explain the technical contents of the disclosure and help understanding of the disclosure, and are not intended to limit the scope of the disclosure. That is, it will be apparent to those skilled in the art that other modifications and changes may be made thereto on the basis of the technical spirit of the disclosure. Further, the above respective embodiments may be employed in combination, as necessary. For example, the methods proposed in the disclosure may be partially combined to operate a base station and a terminal. Further, although the above embodiments have been described by way of the LTE/LTE-A system, other variants based on the technical idea of the embodiments may be implemented in other systems such as 5G and NR systems.

What is claimed is:

1. An antenna module comprising:

a first antenna array configured to form a beam in a specific direction;

a second antenna array spaced a first distance apart from the first antenna array and configured to form a beam in a specific direction; and a lens spaced a second distance apart from beam radiation surfaces of the first antenna array and the second antenna array and configured to change phases of the beams formed by the first antenna array and the second antenna array, wherein the lens comprises a first region and a second region each having a different phase-quantized resolution.

2. The antenna module of claim 1, wherein the first region is a region to which the beam formed by the first antenna array and the beam formed by the second antenna array are transmitted with overlapping, and the second region includes respective regions to which the beam formed by the first antenna array is transmitted without overlapping a beam formed by any other antenna array and to which the beam formed by the second antenna array is transmitted without overlapping a beam formed by any other antenna array.

3. The antenna module of claim 2, wherein the phase-quantized resolution of the first region is 180° and the phase-quantized resolution of the second region is less than 180°.

4. The antenna module of claim 2, wherein the respective regions of the second region include a third region to which only the beam formed by the first antenna array is transmitted and a fourth region to which only the beam formed by the second antenna array is transmitted, and quantized resolutions of the third region and the fourth region are different from each other.

5. The antenna module of claim 2, wherein the lens is a plane lens including unit cells having a plurality of shapes, and a phase of a beam changed through the lens is based on the shapes of the unit cells.

6. The antenna module of claim 5, wherein the first region includes a unit cell having a first shape and a unit cell having a second shape.

7. The antenna module of claim 5, wherein a number of kinds of unit cell shapes comprising the first region and the second region is based on the phase-quantized resolutions of the first and second regions, and the number of kinds of unit cell shapes comprising the second region is larger than the number of kinds of unit cells comprising the first region.

8. An antenna module comprising:

a first antenna array configured to form a beam in a specific direction;

a second antenna array spaced a first distance apart from the first antenna array and configured to form a beam in a specific direction;

a first lens disposed in a region to which the beam formed by the first antenna array and the beam formed by the second antenna array are transmitted with overlapping, and configured to change phases of the transmitted beams; and a second lens including a lens disposed in a region to which one of the beam formed by the first antenna array or the beam formed by the second antenna array is transmitted without overlapping a beam formed by any other antenna array, and configured to change a phase of the transmitted beam.

9. The antenna module of claim 8, wherein phase-quantized resolutions of the first lens and the second lens are different from each other.

10. The antenna module of claim 8, wherein a phase-quantized resolution of the first lens is 180° and a phase-quantized resolution of the second lens is less than 180°.

11. The antenna module of claim 8, wherein the second lens includes:

a third lens to which only the beam formed by the first antenna array is transmitted; and a fourth lens to which only the beam formed by the second antenna array is transmitted, and wherein quantized resolutions of the third lens and the fourth lens are different from each other.

12. The antenna module of claim 8, wherein the first lens and the second lens are each plane lenses comprising unit cells having a plurality of shapes, and phases of beams changed through the first lens and the second lens, respectively, are based on the shapes of the unit cells.

13. The antenna module of claim 12, wherein the first lens includes a unit cell having a first shape and a unit cell having a second shape.

14. The antenna module of claim 12, wherein a number of kinds of unit cell shapes comprising the first lens and the second lens is based on phase-quantized resolutions of the first and second lenses, and the number of kinds of unit cell shapes comprising the second lens is larger than the number of kinds of unit cells comprising the first lens.

15. A communication device comprising:

a first antenna array configured to form a beam in a specific direction;

a second antenna array spaced a first distance apart from the first antenna array and configured to form a beam in a specific direction, and a lens spaced a second distance apart from beam radiation surfaces of the first antenna array and the second antenna array and configured to change phases of the beams formed by the first antenna array and the second antenna array, wherein the lens comprises a first region and a second region each having a different phase-quantized resolution.

16. The communication device of claim 15, wherein the first region is a region to which the beam formed by the first antenna array and the beam formed by the second antenna array are transmitted with overlapping, and the second region includes respective regions to which the beam formed by the first antenna array is transmitted without overlapping a beam formed by any other antenna array and to which the beam formed by the second antenna array is transmitted without overlapping a beam formed by any other antenna array.

17. The communication device of claim 16, wherein the phase-quantized resolution of the first region is 180° and the phase-quantized resolution of the second region is less than 180°.

18. The communication device of claim 16, wherein the respective regions of the second region include a third region to which only the beam formed by the first antenna array is transmitted and a fourth region to which only the beam formed by the second antenna array is transmitted, and quantized resolutions of the third region and the fourth region are different from each other.

19. The communication device of claim 16, wherein the lens is a plane lens including unit cells having a plurality of shapes, and a phase of a beam changed through the lens is based on the shapes of the unit cells.

20. The communication device of claim 19, wherein a number of kinds of unit cell shapes comprising the first region and the second region is based on the phase-quantized resolutions of the first and second regions, and the number of kinds of unit cell shapes comprising the second region is larger than the number of kinds of unit cells comprising the first region.

* * * * *